US006687482B2

(12) United States Patent
Maeda et al.

(10) Patent No.: US 6,687,482 B2
(45) Date of Patent: Feb. 3, 2004

(54) HEATING APPARATUS AND IMAGE FORMING APPARATUS INCORPORATING THE SAME

(75) Inventors: Tomohiro Maeda, Osaka (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/268,603

(22) Filed: Oct. 10, 2002

(65) Prior Publication Data

US 2003/0113143 A1 Jun. 19, 2003

(30) Foreign Application Priority Data

Oct. 10, 2001 (JP) ..... P2001-313082

(51) Int. Cl.[7] ..... G03G 15/20

(52) U.S. Cl. ..... 399/333; 219/216; 219/619; 399/328; 399/330

(58) Field of Search ..... 399/328, 320, 399/333, 330, 331, 332, 335; 219/216, 243, 244, 619, 624, 469; 430/124; 492/46, 53, 56, 18, 49; 118/60

(56) References Cited

U.S. PATENT DOCUMENTS 5,890,043 A * 3/1999 Uehara ..... 430/124
6,263,172 B1 * 7/2001 Suzuki et al. ..... 399/328
6,359,269 B1 * 3/2002 Hayasaki et al. ..... 219/619
6,463,250 B1 * 10/2002 Chen et al. ..... 399/330
6,505,029 B2 * 1/2003 Ishizaki et al. ..... 399/333
6,567,641 B1 * 5/2003 Aslam et al. ..... 399/330

FOREIGN PATENT DOCUMENTS

JP 07064419 A * 3/1995 ..... G03G/15/20
JP 08-129313 5/1996
JP 2000-214702 * 8/2000
JP 2001-312168 * 11/2001
JP 2002-049261 * 2/2002

* cited by examiner

*Primary Examiner*—Sophia S. Chen
(74) *Attorney, Agent, or Firm*—Edwards & Angell, LLP; David G. Conlin; George W. Hartnell, III

(57) ABSTRACT

The fixing apparatus which acts as a heating apparatus, includes a heating roller; a pressure-applying roller, arranged face to face with the heating roller, for allowing a recording sheet to be conveyed by the heating and pressure-applying rollers as nipped therebetween; and a heating device for heating the heating roller. The heating roller has a first elastic layer made of an elastic material, a conductive layer disposed in the outer periphery of the first elastic layer, an elasticity-imparted second elastic layer disposed in the outer periphery of the conductive layer, and a peeling layer disposed in the outer periphery of the second elastic layer. The conductive layer of the heating roller is induction-heated by the heating device, thereby reducing the warm-up time. By providing the second elastic layer, adequate elasticity is imparted to the heating roller's surface. The toner image on the recording sheet excels in fixability and gloss property.

10 Claims, 4 Drawing Sheets

HEATING APPARATUS AND IMAGE FORMING APPARATUS INCORPORATING THE SAME

BACKGROUND OF THE INVENTION

1. Field of the Invention

The present invention relates to a heating apparatus that is suitable for a fixing apparatus for use in a dry-type electrophotographic apparatus; a drying apparatus for use in a wet-type electrophotographic apparatus; a drying apparatus for use in an ink jet printer; or an erasing apparatus for a rewritable medium. The invention also relates to an image forming apparatus employing said heating apparatus.

2. Description of the Related Art

A heating apparatus has hitherto been used as a fixing apparatus for fixing a toner image onto a recording sheet in an electrophotographic copier or printer, for example. In a conventional fixing apparatus, inside a heating roller having a hollow core metal made of aluminum or the like is arranged a halogen lamp. By driving the halogen lamp to liberate heat, the heating roller is heated to a predetermined temperature.

However, the above-described method using a halogen lamp poses a problem that a long warm-up time is required due to a sluggish rise of temperature upon starting of heating. To shorten the warm-up time, it can be considered that the thickness of the heating roller is reduced to decrease thermal capacity. However, a reduction in the thickness of the heating roller is necessarily accompanied by a decrease in rigidity. If the rigidity of the heating roller is low, the heating roller suffers from considerably large distortion when pressed by a pressure-applying roller, resulting in a decrease in a pressure-applying force exerted on the longitudinal central portion of the heating roller. This causes fixing failure. In the end, there is a limit to shortening of the warm-up time in accompaniment with a decrease in capacity achieved by reducing the thickness of the heating roller. In particular, in a fixing apparatus with a halogen lamp designed for use in a color image forming apparatus, outside a core metal is formed a 1 to 3 mm-thick elastic layer. Therefore, even if the thickness of the core metal is reduced to decrease thermal capacity, the elastic layer has large thermal capacity, and thus it takes much time for warming up. In addition, a reduction in the thickness of the elastic layer leads to fixing failure. In the end, there is also a limit to reducing the thickness of the elastic layer.

To solve the above-described problems associated with the conventional fixing apparatus, Japanese Unexamined Patent Publication JP-A 8-129313 (1996) discloses one prior art practice. The prior art disclosed in JP-A 8-129313 is as follows. There is provided a heating roller having an elastic layer formed inside. Outside the elastic layer is formed a 10 to 150 $\mu$m-thick conductive layer. In the heating roller, the conductive layer is heated externally. Formed in the outer periphery of the conductive layer is a peeling layer. The features of the disclosed prior art will be described below.

Since the heating roller is formed of a thin conductive layer, its thermal capacity can be kept small, whereby making it possible to shorten the warm-up time. Moreover, the conductive layer has adequate rigidity and is securely formed on the elastic layer fixed onto the core metal. Thus, excellent durability can be attained in the heating roller. By providing an elastic layer inside the heating roller and by exploiting the elasticity of the pressure-applying roller, it is possible to increase flexibility in selecting a width of a nip portion where the heating roller and the pressure-applying roller make contact with each other. This makes it possible to achieve speedup in the operation of the image forming apparatus. The axial distortion of the pressure-applying roller is diminished by the elastic layer formed inside the heating roller, so that the longitudinal width of the nip portion is kept uniform. Hence, load on a material to be heated is made uniform and thus occurrence of a ripple or other troubles can be prevented. Moreover, the adequate rigidity of the conductive layer serves to make uniform the longitudinal width of the nip portion. By setting the surface hardness of the pressure-applying member to be equivalent to or higher than that of the heating roller, the nip portion can be made flat, thus preventing the to-be-heated material from curling up due to the curvature of the heating roller.

With the prior art disclosed in JP-A 8-129313, however, although the warm-up time can be shortened successfully, the surface of the heating roller is made undesirably hard, because the peeling layer is formed directly in the outer periphery of the conductive layer. An unfixed to-be-heated material has, on its top surface, irregular concavities and convexities ascribable to presence/absence of toner, or to difference in toner layer thickness. Therefore, when heat is applied to a toner image formed on the to-be-heated material by the heating roller having a hard surface, the heating roller fails to conform to the irregular concavities and convexities, resulting in occurrence of uneven heating. This leads to fixing failure and uneven gloss. In particular, when a color image formed by stacking together a plurality of toner images of different colors is subjected to fixing, it is impossible to obtain adequate fixability.

SUMMARY OF THE INVENTION

An object of the invention is to provide a heating apparatus that allows shortening of warm-up time and ensures excellent fixability and gloss property, and an image forming apparatus incorporating the heating apparatus.

The invention provides a heating apparatus comprising:

a heating rotary member including: a first elastic layer made of a material having elasticity; a conductive layer disposed in an outer periphery of the first elastic layer; a second elastic layer made of a material having elasticity, which is disposed in an outer periphery of the conductive layer; and a peeling layer disposed in an outer periphery of the second elastic layer;

a pressure-applying member disposed in press-contact with the heating rotary member, for allowing a sheet-like to-be-heated material to be conveyed by the heating rotary member and the pressure-applying member as nipped therebetween; and heating means for applying heat to the conductive layer of the heating rotary member.

According to the invention, the heating rotary member is provided with the second elastic layer, which is made of a material having elasticity, formed in between the conductive layer disposed in the outer periphery of the first elastic layer and the peeling layer. This helps keep the surface of the heating rotary member from becoming hard, and thus allow the heating rotary member to be elastically deformed adequately. In this connection, assuming that, e.g. a toner image is formed on a to-be-heated material which is conveyed by the heating rotary member and the pressure-applying member as nipped therebetween. In this case, even if concavities and convexities are created on the surface of the to-be-heated material due to the presence of the toner image, since the surface of the heating rotary member conforms to the concavities and convexities, occurrence of uneven heating can be avoided. Consequently, it is possible to secure a wide non-offset region, i.e., a fixing temperature range such as to obtain a high-quality fixed image in which toner is molten sufficiently and is thus no longer peeled off.

In the invention, it is preferable that a tensile elasticity modulus of the peeling layer is kept in a range from $1.96\times10^8$ Pa to $9.8\times10^8$ Pa.

If the tensile elasticity modulus of the peeling layer exceeds $9.8\times10^8$ Pa, the peeling layer becomes so hard that the heating rotary body fails to conform to the concavities and convexities completely, resulting in occurrence of uneven heating. For example, when a to-be-heated material having a toner image formed thereon is subjected to heating, toner fixing failure or uneven gloss occurs inevitably. On the other hand, if the tensile elasticity modulus of the peeling layer is less than $1.96\times10^8$ Pa, the peeling layer becomes too soft. Thus, although the heating rotary body is able to conform to the concavities and convexities on the to-be-heated material completely, it is impossible to obtain a sufficient effect of infiltrating toner into the to-be-heated material by melting. Consequently, excellent gloss property cannot be attained. Hereupon, according to the invention, by keeping the tensile elasticity modulus of the peeling layer within the above-described range, adequate elasticity can be imparted to the heating roller. Consequently, toner is allowed to infiltrate into the to-be-heated material while the heating rotary member conforms to toner concavities/convexities to some extent, whereby making it possible to obtain sufficient gloss property.

In the invention, it is preferable that the second elastic layer has a thickness in a range from 50 to 300 $\mu$m.

If the thickness of the second elastic layer exceeds 300 $\mu$m, the thermal capacity is increased, with the result that a long warm-up time is required. On the other hand, if the thickness of the second elastic layer is less than 50 $\mu$m, the second elastic layer fails to provide sufficient elasticity, with the result that the surface of the heating rotary member no longer conforms to the concavities and convexities on the to-be-heated material. Hereupon, according to the invention, by keeping the thickness of the second elastic layer within the above-described range, it is possible to shorten the warm-up time and to prevent occurrence of uneven heating.

In the invention, it is preferable that the peeling layer has a thickness in a range from 5 to 50 $\mu$m.

The peeling layer is located on the surface of the heating rotary member and brought into contact with the to-be-heated material. In view of this, if its thickness is less than 5 $\mu$m, the durability becomes insufficient. On the other hand, if the thickness of the peeling layer exceeds 50 $\mu$m, the elastic effect exerted by the second elastic layer, formed on the lower part of the peeling layer, is cancelled out, and thus the surface of the heating rotary member becomes hard. This leads to uneven heating. Hereupon, according to the invention, by keeping the thickness of the peeling layer within the above-described range, it is possible to realize a highly-durable heating apparatus free from uneven heating.

In the invention, it is preferable that the conductive layer has a thickness in a range from 10 to 100 $\mu$m.

If the thickness of the conductive layer exceeds 100 $\mu$m, the rigidity of the conductive layer becomes so high that, despite the presence of the elasticity of the first elastic layer located below the conductive layer, it is impossible to obtain an effect of forming a distortion jointly with the pressure-applying member. Consequently, the to-be-heated material having passed through a region between the heating rotary member and the pressure-applying member falls off upwardly. Moreover, it is impossible to secure an adequate width in the nip portion where the heating rotary member and the pressure-applying roller make press-contact with each other. Further, since the thermal capacity is increased, a long warm-up time is required. On the other hand, if the thickness of the conductive layer is less than 10 $\mu$m, the durability is deteriorated, resulting in a breakage of the conductive layer. Moreover, since the thermal capacity is decreased, the to-be-heated material is subjected to considerable heat radiation. Consequently, in the case of conveying to-be-heated materials one after another, the heat radiation outruns the heating action. Hereupon, according to the invention, by keeping the thickness of the conductive layer within the above-described range, it is possible to obtain adequate rigidity and excellent durability. In addition, since the thermal capacity is kept within an appropriate range, the warm-up time can be shortened.

In the invention, it is preferable that the second elastic layer is made of silicone rubber.

According to the invention, by forming the second elastic layer from silicone rubber, excellent heat resistance can be attained. Moreover, since the conformability with respect to the concavities and convexities created on the surface of the to-be-heated material is improved, sufficient fixability can be secured.

In the invention, it is preferable that the peeling layer is made of a fluorine material.

According to the invention, by forming the peeling layer from a fluorine material, it is possible to obtain satisfactory peeling property for the surface of the heating rotary member and the toner deposited on the to-be-heated material. Moreover, the gloss property of the toner fixed onto the to-be-heated material can be enhanced to a sufficient degree.

In the invention, it is preferable that a surface roughness of the peeling layer is set at 0.3 $\mu$m or below in terms of average surface roughness on the center line Ra, or set at 1.0 $\mu$m or below in terms of ten point average surface roughness Rz.

If the center-line average surface roughness Ra, representing the surface roughness, exceeds 0.3 $\mu$m, or the ten point average surface roughness Rz exceeds 1.0 $\mu$m, a non-offset region cannot be secured sufficiently. Hereupon, according to the invention, by keeping the surface roughness within the above-described range, it is possible to secure a sufficiently wide non-offset region.

In the invention, it is preferable that the heating means is induction heating means for generating induced currents by applying an alternating magnetic field to the conductive layer, and the conductive layer liberates heat in the alternating magnetic field.

According to the invention, used as the heating means is the induction heating means for generating induced currents by applying an alternating magnetic field to the conductive layer. Thus, the structure of the heating roller can be simplified, and further the heating roller can be heated uniformly in a short period of time.

The invention further provides an image forming apparatus comprising:

a heating apparatus including: a heating rotary member having a first elastic layer made of a material having elasticity, a conductive layer disposed in an outer periphery of the first elastic layer, a second elastic layer, made of a material having elasticity, disposed in an outer periphery of the conductive layer, and a peeling layer disposed in an outer periphery of the second elastic layer; a pressure-applying member disposed in press-contact with the heating rotary member, for allowing a sheet-like to-be-heated material to be conveyed by the heating rotary member and the pressure-applying member as nipped therebetween; and heating means for applying heat to the conductive layer of the heating rotary member;

a visible image forming unit for forming a toner image on a to-be-heated material; and conveying means for conveying a to-be-heated material having a toner image formed thereon in a region between the heating rotary member and the pressure-applying member.

According to the invention, the image forming apparatus includes the above stated heating apparatus. Thus, with the image forming apparatus, it is possible to form a high-quality image in correspondence with a wide range of setting temperatures of the heating apparatus.

According to the invention, the surface of the heating rotary member is kept from becoming hard, and thus the heating rotary member can be elastically deformed adequately. In this connection, assuming that a toner image, for example, is formed on a to-be-heated material which is conveyed by the heating rotary member and the pressure-applying member as nipped therebetween. In this case, even if concavities and convexities are created on the surface of the to-be-heated material due to the presence of the toner image, since the surface of the heating rotary member conforms to the concavities and convexities, occurrence of uneven heating can be avoided. Consequently, it is possible to secure a wide non-offset region, i.e., fixing temperature range of obtaining a high-quality fixed image in which toner is molten sufficiently and is thus no longer peeled off. Moreover, toner is allowed to infiltrate into the to-be-heated material properly so as to obtain sufficient gloss property. Further, the conductive layer to be heated is made thin-walled, and the heating rotary member is heated by exploiting an alternating magnetic field. This helps shorten the warm-up time. Hence, an energy-efficient, energy-saving fixing apparatus can be realized.

According to the invention, the image forming apparatus employs a heating apparatus having a wide non-offset region. Thus, with the image forming apparatus, it is possible to form a high-quality image in correspondence with a wide range of setting temperatures of the heating apparatus.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
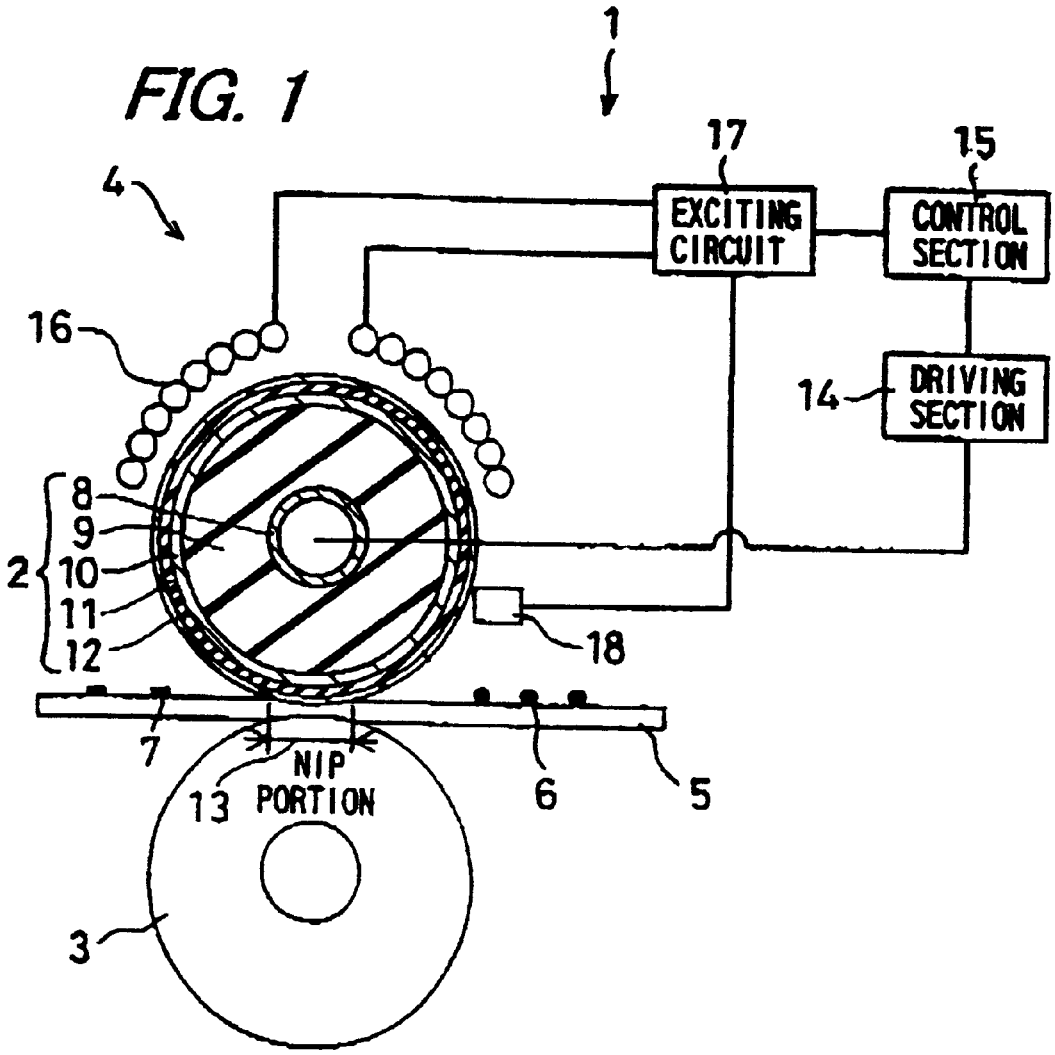
FIG. 1 is a schematic sectional view showing a simplified structure of a fixing apparatus 1 practiced as a heating apparatus in accordance with one embodiment of the invention.

Now referring to the drawings, preferred embodiments of the invention are described below.

FIG. 1 a schematic sectional view showing a simplified structure of a fixing apparatus 1 practiced as a heating apparatus in accordance with one embodiment of the invention. The fixing apparatus 1 includes: a heating roller 2, i.e., a heating rotary member; a pressure-applying roller 3, i.e., a pressure-applying member; and heating means 4. The heating roller 2, which has a hollow structure, serves to apply heat to a recording sheet 5, i.e., a material to be heated. The pressure-applying roller 3 is arranged face to face with the heating roller 2 so as to be pressed against the heating roller 2. The heating means 4 is arranged outwardly of the heating roller 2. The fixing apparatus 1 performs fixation as follows. The recording sheet 5 carrying a toner image is conveyed by the heating roller 2 and the pressure-applying roller 3 as nipped therebetween. Thereby, the toner image transferred onto the recording sheet 5 is heated and molten to be fixed onto the recording sheet 5. FIG. 1 shows a change of state of toner, that is, a change from unfixed toner 6 to fixed toner 7.

The heating roller 2 is composed of: a core body 8; a first elastic layer 9, made of a material having elasticity, disposed on an outer peripheral surface of the core body 8; a conductive layer 10, made of a material having conductivity, arranged in an outer periphery of the first elastic layer 9; a second elastic layer 11, made of a material having elasticity, arranged in an outer periphery of the conductive layer 10; and a peeling layer 12 formed so as to cover an outer periphery of the second elastic layer. The core body 8 is formed of a metal member, such as aluminum or iron, having an axially uniform sectional profile. In this embodiment, the core body 8 has a hollow cylindrical shape. However, the core body 8 is not limited to a hollow configuration, but may be of either a hollow or solid configuration. It should be noted here that a hollow configuration is superior to a solid configuration in point of suppression of heat radiation. Thus, a hollow configuration is more desirable from the viewpoint of suppressing a loss of heat in the heating roller 2.

The first elastic layer 9 is formed of a porous elastic body made of a heat-insulating heatproof sponge, for example a silicone rubber. The first elastic layer 9 acts to fix the conductive layer 10, arranged outwardly thereof, by exploiting contact friction occurring therebetween. Thus, the first elastic layer 9 exerts adequate elastic repulsive force on the conductive layer 10 which constrains the first elastic layer 9 from the outer peripheral side.

The conductive layer 10, which is cylindrically shaped, has a thickness kept in a range from 10 to 100 $\mu$m. The conductive layer 10 is a heat-generating member that liberates heat through induction of currents in an alternating magnetic field produced by the heating means 4. In order to shorten the time required for the surface temperature of the heating roller 2 to rise, the conductive layer 10 is made of a thin-walled material having the aforementioned thickness. If the thickness of the conductive layer 10 is less than 10 $\mu$m, its durability becomes insufficient, resulting in breakage of the conductive layer 10 during rotation of the heating roller 2. On the other hand, if the thickness of the conductive layer 10 exceeds 100 $\mu$m, the thermal capacity is increased, with the result that a long warm-up time is required. Hereupon, by keeping the thickness of the conductive layer 10 within the above-described range, it is possible to shorten the warm-up time and to enhance the durability.

The conductive layer 10 should preferably be made of iron, stainless steel represented by SUS 430, or any other conductive members having magnetic property. A material exhibiting high relative permeability is particularly desirable. Other preferred examples thereof include: a silicon steel plate; an electromagnetic steel plate; and a nickel steel plate. Note that a non-magnetic body may be used for the conductive layer 10, so long as it has high resistance value, e.g. SUS-304 stainless steel, because such a material can be subjected to induction heating. Note also that a material including a non-magnetic element such as ceramic as a base may be used for the conductive layer 10, so long as a high-relative-permeability material as described just above is arranged in the base to secure conductivity. Moreover, the conductive layer 10 may alternatively be formed of a plurality of sleeves to increase an amount of heat to be generated.

The second elastic layer 11, formed on the conductive layer 10, is made of a material which is excellent in heat resistance and has rubber elasticity. Specific examples thereof include: silicone rubber; fluorine rubber; and fluorosilicone rubber. Silicone rubber which is excellent in rubber elasticity is particularly desirable as the second elastic layer 11. The second elastic layer 11 has a thickness kept in a range from 30 to 300 $\mu$m. If the thickness of the second elastic layer 11 is less than 30 $\mu$m, the surface of the heating roller 2 becomes so hard that the heating roller 2 fails to conform to concavities and convexities of a toner image formed on the recording sheet 5, resulting in occurrence of uneven heating. On the other hand, if the thickness of the second elastic layer 11 exceeds 300 $\mu$m, the thermal capacity is increased, with the result that a long warm-up time is required. Hereupon, by keeping the thickness of the second elastic layer 11 within the above-described range, it is possible to shorten the warm-up time and to prevent occurrence of uneven heating.

The peeling layer 12 is formed in the outer periphery of the second elastic layer 11. The peeling layer 12 is heated at a nip portion 13 where the heating roller 2 and the pressure-applying roller 3 make contact with each other. This prevents toner having decreased viscosity from adhering to the heating roller 2. Used as a material for the peeling layer 12 is a fluorine material, for example PFA (tetrafluoroethylene-perfluoroalkylvinylether copolymer) or PTFE (polytetrafluoroethylene). By forming the peeling layer 12 from a fluorine material, it is possible to obtain satisfactory peeling property for the heating roller 2 and the toner deposited on the recording sheet 5.

The thickness of the peeling layer 12 is kept in a range from 5 to 50 $\mu$m. If the thickness of the peeling layer 12 is less than 5 $\mu$m, the durability becomes insufficient. On the other hand, if the thickness of the peeling layer 12 exceeds 50 $\mu$m, the thermal capacity is increased, with the result that a long warm-up time is required. Moreover, since the surface of the heating roller 2 becomes hard, the elastic effect exerted by the second elastic layer 11 is cancelled out. Hereupon, by keeping the thickness of the peeling layer 12 within the above-described range, it is possible to enhance the durability and to shorten the warm-up time.

The heating roller 2 is rotatably supported by the body of the fixing apparatus 1. The heating roller 2 has a non-illustrated gear, etc. attached to the axial end thereof. The heating roller 2 is rotatably driven by a motor or the like, acting as a driving section 14, via the gear, etc. The driving section 14 is controlled by a control section 15 composed of a CPU (Central Processing Unit), etc.

The pressure-applying roller 3, which is columnar-shaped or cylindrically shaped, is formed by providing a heatproof elastic body layer such as silicone rubber on an outer peripheral surface of a core metal made of stainless or aluminum. On the outer peripheral surface of the heatproof elastic body layer may additionally be formed a peeling layer made of PFA, PTFE, or the like for preventing adhesion of toner. The pressure-applying roller 3 is kept press-contact with the heating roller 2 by, for example, a spring member. In this way, the nip portion 13 is formed in between the heating roller 2 and the pressure-applying roller 3.

The heating means 4 serves to apply heat to the conductive layer 10 through electromagnetic induction. The heating means 4 includes: an induction coil 16; an exciting circuit 17 for applying high-frequency currents to the induction coil 16; and a temperature detector 18 for detecting the surface temperature of the heating roller 2. The exciting circuit 17 is activated in response to an output from the temperature detector 18. Moreover, the exciting circuit 17 is connected to the control section 15 so as to be operated under the control of the control section 15. The temperature detector 18 may be formed either of a contact type thermometer such as a thermistor or a thermocouple thermometer, or of a non-contact type thermometer such as a radiation thermometer.

Figure 2:
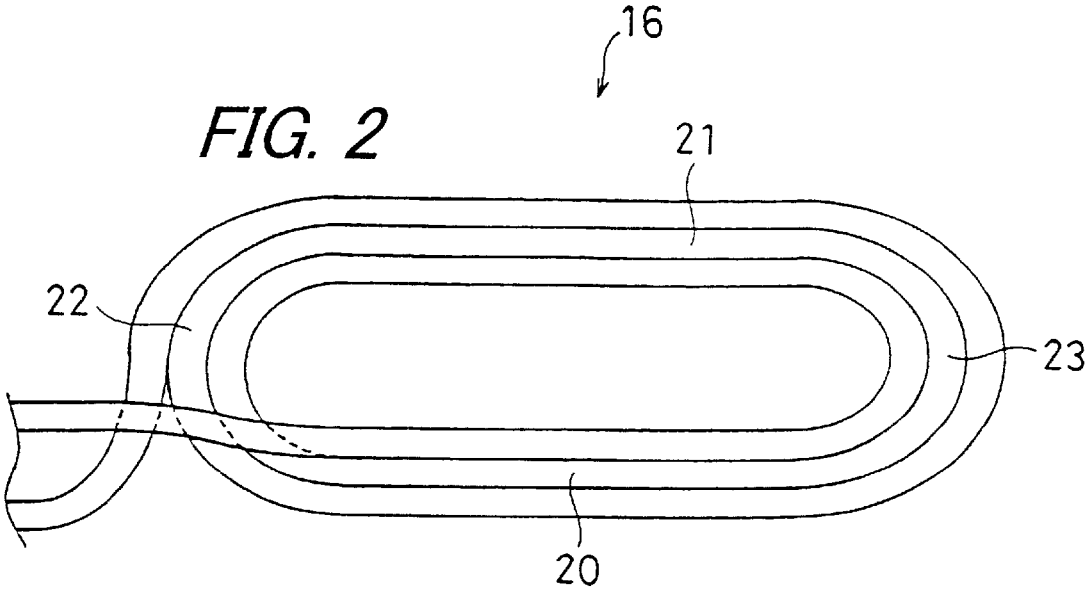
FIG. 2 is a plan view showing an induction coil 16.

FIG. 2 is a plan view showing the induction coil 16. The induction coil 16 is formed of a wire rod shaped into a coil having an oblong projected shape. The induction coil 16 includes a pair of extension coil portions 20 and 21, and a pair of curved coil ends 22 and 23. The extension coil portion 20, 21 extends along the axial direction of the heating roller 2. The curved coil end 22, 23 is arranged in the vicinity of each axial end of the heating roller 2; is made continuous with each end of the extension coil portion 20, 21; extends circumferentially of the heating roller 2; and serves to join together the one and the other end of the extension coil portion 20, 21.

In consideration of heat resistance, the induction coil 16 is preferably formed of, for example an aluminum single wire having a surface insulating layer made of an oxide coating film. The material used for the induction coil 16 is not limited to the aluminum single wire, but may be of a copper wire, a wire of copper-base composite material, or a litz wire formed of an enamel stranded wire. In either case, in order to suppress energy losses attributed to resistive heat generation in the induction coil 16 per se, the total resistance of the induction coil 16 is set at 0.5 Ω or below, more preferably 0.1 Ω or below.

The induction coil 16, arranged so as to surround the heating roller 2, is formed in a curvature-imparted shape. Thus, magnetic flux converges to the center of the induction coil 16, resulting in an increase in eddy currents generation. This allows the surface temperature of the heating roller 2 to rise in a short period of time. The induction coil 16 may be arranged plurally, depending on the dimension of the recording sheet 5 subjected to a fixing process. By applying high-frequency currents to the induction coil 16 through the exciting circuit 17, an alternating magnetic field is generated, and thereby the conductive layer 10 disposed in the heating roller 2 is induction-heated. The induction heating of the conductive layer 10 causes a rise in the temperature of the heating roller 2, whereupon the temperature detector 18, arranged on the upstream side of the nip portion 13 along the recording sheet 5 conveying direction, starts to detect the surface temperature of the heating roller 2. In response to detection signals fed from the temperature detector 18, the control section 15 controls the exciting circuit 17, so that the surface temperature of the heating roller 2 is kept constant.

Next, a description will be given below as to the working of the fixing apparatus 1 thus constructed. Firstly, at the time of warming up, the exciting circuit 17 is activated to energize the induction coil 16. Upon the energization of the induction coil 16, an alternating magnetic field is generated, and thereby eddy currents are induced in the conductive layer 10 of the heating roller 2. Consequently, heat is generated due to Joule effect. Moreover, at the instant when the induction coil 16 is energized by the exciting circuit 17, the heating roller 2 is rotatably driven by the driving section 14, so that the pressure-applying roller 3, being pressed by the heating roller 2, is trailingly rotated. The surface temperature of the heating roller 2 is constantly detected by the temperature detector 18. When the surface temperature of the heating roller 2 reaches a predetermined working temperature, the warming up is completed, and then the energization of the induction coil 16 conducted by the exciting circuit 17 is switched to ON-OFF control. Thereby, the surface temperature of the heating roller 2 is maintained at the predetermined working temperature.

Upon completion of the warming up, the recording sheet, onto which an image of the unfixed toner 6 is transferred, is caused to pass through the nip portion 13 of the fixing apparatus 1. Whereupon, the unfixed toner 6 is heated by the heating roller 2, and also pressurized by the pressure between the heating roller 2 and the pressure-applying roller 3, and is thereby molten and fixed onto the recording sheet 5, thereby forming a fixed image.

Figure 3:
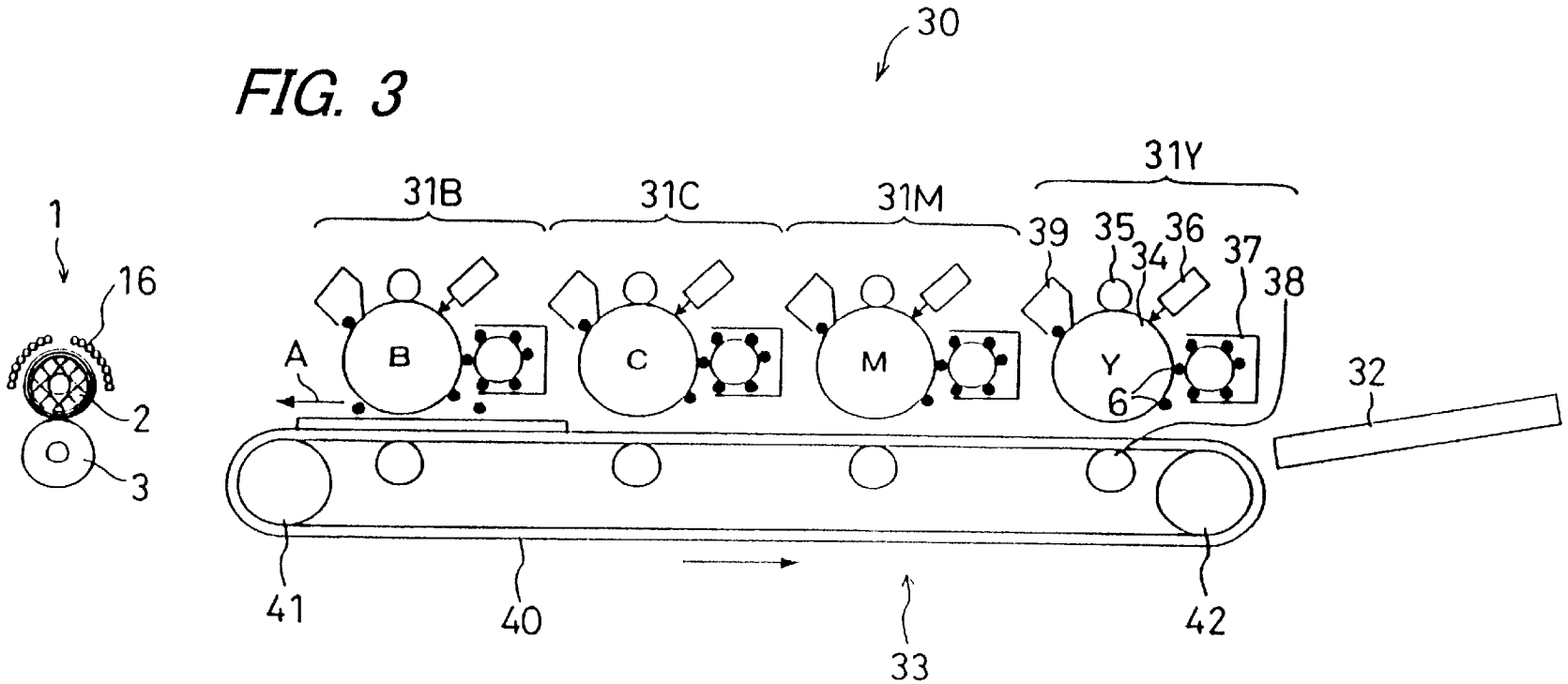
FIG. 3 is a schematic sectional view showing a simplified structure of a color image forming apparatus 30 incorporating the fixing apparatus 1.

FIG. 3 is a schematic sectional view showing a simplified structure of a color image forming apparatus 30 incorporating the fixing apparatus 1 shown in FIG. 1. The color image forming apparatus 30 is built as a dry-type electrophotographic apparatus, specifically, a so-called tandem-type printer in which four pieces of visible image forming units 31Y, 31M, 31C, and 31B are arranged side by side along the recording sheet 5 conveying direction. The color image forming apparatus 30 includes: the fixing apparatus 1; the four visible image forming units 31Y, 31M, 31C, and 31B for forming a toner image on the recording sheet 5; a recording sheet tray 32 for accommodating the recording sheet 5; and conveying means 33 for conveying the recording sheet 5 in a region between the heating roller 2 and the pressure-applying roller 3. The recording sheet tray 32 is arranged on the uppermoststream side along the recording sheet conveying direction indicated by arrow A. In the recording sheet tray 32, a set of recording sheets 5 are placed, and they are fed separately one by one.

The visible image forming units 31Y, 31M, 31C, and 31B serve to form a yellow (Y) toner image, a magenta (M) toner image, a cyan (C) toner image, and a black (B) toner image, respectively, on the recording sheet 5. The visible image forming units 31Y, 31M, 31C, and 31B are arranged in the order named along the conveying means 33, from the upstream side to the downstream side, in the recording sheet 5 conveying direction indicated by the arrow A.

The visible image forming units 31Y, 31M, 31C, and 31B each include: a photoconductive drum 34; a charging roller 35; a laser irradiation unit 36; a developing apparatus 37; a transfer roller 38; and a cleaner 39. The photoconductive drum 34 is rotatably supported by the body of the image forming apparatus 30. On the surface of the photoconductive drum 34 is formed an electrostatic latent image. The charging roller 35 is arranged face to face with the photoconductive drum 34, for charging the surface of the photoconductive drum 34 uniformly. The laser irradiation unit 36 serves to expose the surface of the photoconductive drum 34 to laser light in accordance with image information, whereupon an electrostatic latent image is formed. The developing apparatus 37 is arranged face to face with the photoconductive drum 34, with a predetermined interval secured therebetween. The developing apparatus 37 supplies toner to the photoconductive drum 34, and visualizes the electrostatic latent image through development.

The transfer roller 38 is arranged face to face with the photoconductive drum 34, with a subsequently-described endless belt 40 disposed in between. Through application of a bias voltage which is opposite in polarity to the toner, the transfer roller 38 transfers the toner image formed on the surface of the photoconductive drum 34 onto the recording sheet 5. After the toner image is transferred from the photoconductive drum 34 onto the recording sheet 5, the cleaner 39 removes residual toner remaining on the surface of the photoconductive drum 34, and performs cleaning on the surface of the photoconductive drum 34 in preparation for subsequent development.

The conveying means 33 includes a pair of driving roller 41 and idling roller 42, and the endless belt 40 which is rotatably entrained about the driving roller 41 and the idling roller 42. The driving roller 41 is driven by a motor or the like to rotate about an axis which is perpendicular to the plane of the paper carrying FIG. 3. The idling roller 42 has no driving source. However, a rotational driving force exerted by the driving roller 41 is transmitted to the idling roller 42 by the endless belt 40, and thereby the idling roller 42 is trailingly rotated about an axis which is parallel to the axis of the driving roller 41. The endless belt 40, entrained about the driving roller 41 and the idling roller 42, is driven to rotate in the direction indicated by the arrow A concurrently with the rotation of the driving roller 41, so that the recording sheet 5 is conveyed while being kept in a clinging state by dint of static electricity.

In the color image forming apparatus 30, an image is formed as follows. The recording sheet 5, fed from the recording sheet tray 20 one by one, is conveyed in the arrow A direction by the endless belt 40. Firstly, in the visible image forming unit 31Y, the photoconductive drum 34 has its surface uniformly charged by the charging roller 35. Thereafter, the surface of the photoconductive drum 34 is exposed to laser light, by the laser irradiation unit 36, in accordance with image information, whereupon an electrostatic latent image is formed. The electrostatic latent image on the photoconductive drum 34 is then developed by the toner fed from the developing apparatus 37, and the resultant visualized toner image is transferred onto the recording sheet 5 placed on the endless belt 40, by the transfer roller 38 to which a bias voltage which is opposite in polarity to the toner is applied.

During conveyance of the recording sheet 5 in the arrow A direction, toner of different colors is transferred onto the recording sheet 5 one after another by the visible image forming units 31M, 31C, and 31B arranged on the downstream side along the conveying direction. After completion of the transfer conducted by the four visible image forming units 31Y, 31M, 31C, and 31B, the recording sheet 5 is detached from the endless belt 40 by the curvature imparted to the driving roller 41, and is then conveyed to the fixing apparatus 1. In the fixing apparatus 1, the recording sheet 5 carrying the toner image is sandwiched between the heating roller 2 and the pressure-applying roller 3 so as to receive appropriate temperature and pressure. Eventually, the toner is molten and fixed onto the recording sheet 5, thereby forming a fixed image.

Hereafter, embodiments of the invention will be described.

Embodiment 1

The heating roller 2 has the second elastic layer 11 formed in between the conductive layer 10 and the peeling layer 12. Here, examination is made as to the effect of the second elastic layer 11 formed in the heating roller 2 on the fixing performance.

Stated below is the conditions to be satisfied by the members for constituting the fixing apparatus 1 under evaluation as to the fixing performance. Here, the heating roller 2 is constructed as follows. On the core body 8 formed of an aluminum-made hollow core metal having an outer diameter of 28 mm, the first elastic layer 9, i.e. a 6 mm-thick sponge elastic layer obtained by foaming silicone rubber is formed. Arranged in the outer periphery of the first elastic layer 9 is the conductive layer 10 formed of a 40 μm-thick, nickel-made metal sleeve. Evaluation was conducted on each of the following three different-type heating rollers:

(1) a heating roller in which only the 30 μm-thick peeling layer 12 is formed in the outer periphery of the conductive layer 10, and the second elastic layer 11 is absent;

(2) a heating roller in which the second elastic layer 11 is given a thickness of 50 μm, and the 30 μm-thick peeling layer 12 is formed in the outer periphery of the second elastic layer 11; and (3) a heating roller in which the second elastic layer 11 is given a thickness of 300 μm, and the 30 μm-thick peeling layer is formed in the outer periphery of the second elastic layer 11.

The pressure-applying roller 3 is constructed as follows. Arranged outwardly of a core metal having an outer diameter of 20 mm is a 5 mm-thick elastic layer made of silicone rubber. The outer periphery of the elastic layer is covered with a 30 μm-thick PFA tube acting as a peeling layer. Used as the recording sheet 5 is a paper sheet which is 75 g/m$^2$ in weight, i.e. a 75 g paper sheet. Formed on the recording sheet 5 is an unfixed color toner image composed of triple-layered color toner images. The adhesion mass per color toner image is set at 0.6 mg/cm$^2$. The speed at which the recording sheet carrying the unfixed color toner image is conveyed is set at 120 mm/s. Under such conditions, the recording sheet is passed through the nip portion 13 of the fixing apparatus to be subjected to a fixing operation. Moreover, the fixing apparatus 1, instead of incorporating an oil application mechanism for applying oil to the heating roller, employs toner for use in an oilless fixing apparatus that contains wax.

In this embodiment, the fixing performance is evaluated based on a non-offset region and warm-up time. The non-offset region is obtained as follows. The predetermined heating temperature of the heating roller 2, namely, the fixing temperature, is varied. Then, at each varied fixing temperature, the recording sheet 5 carrying a toner image is passed through the nip portion 13, whereupon the fixing operation is executed. In this way, a preferable fixing temperature range is obtained that allows formation of a high-quality fixed image, with the fixed toner image, on the recording sheet 5, without causing a cold offset or hot offset phenomenon.

The warm-up time is set to be the time required for the surface temperature of the heating roller 2 to rise up to 170° C., at which fixation of toner is possible.

Listed in Table 1 are the evaluation results as to the fixing performance. In this table, symbol ○ represents acceptable performance of the fixing apparatus; X represents poor performance; and Δ represents performance at a level between ○ and X.

TABLE 1

| Thickness of second elastic layer (μm) | Thickness of peeling layer (μm) | Non-offset region (° C.) | Warm-up time (s) | Evaluation result |
|---|---|---|---|---|
| absent | 30 | 10 | 9.6 | X |
| 50 | 30 | 30 | 10.8 | ○ |
| 300 | 30 | 30 | 20.2 | Δ |

In a case where the second elastic layer 11 is absent, the surface of the heating roller becomes so hard that the surface of the heating roller 2 fails to conform to minute concavities and convexities of the toner layer created on the recording sheet 5, resulting in occurrence of uneven heating and offset phenomena. Thus, in this case, an attainable non-offset region is as little as 10° C. From the viewpoints of the axial uneven temperature property of the heating roller and occurrence of a temperature-induced ripple, if the non-offset region is less than 20° C., no satisfactory practicality can be attained. On the other hand, in a case where the second elastic layer is formed in a thickness ranging from 50 to 300 μm, the surface of the heating roller 2 conforms to minute concavities and convexities of the toner layer created on the recording sheet 5 by dint of the elasticity of the second elastic layer 11. Thus, in this case, an attainable non-offset region is as much as 30° C.

The shorter the warm-up time is the better. In the case of mounting the fixing apparatus 1 in a copying machine, a time interval between copy reading process and printing, discharge process is less than ca. 20 seconds. Thus, it is preferable that warming up of the fixing apparatus 1 is completed within this time duration. However, if the thickness of the second elastic layer 11 exceeds 300 μm, a long warm-up time of ca. 20 seconds or more is required. Thus, it is not desirable that the second elastic layer 11 has a thickness of greater than 300 μm.

In light of the foregoing measurement results, by setting the thickness of the second elastic layer 11 to a range from 50 to 300 μm, a sufficient non-offset region can be secured, and a high-quality fixed image can be obtained. Moreover, the warm-up time can be shortened.

Embodiment 2

In Embodiment 1, in forming the second elastic layer 11, its appropriate thickness has been examined. In Embodiment 2, examination was made as to such a tensile elasticity modulus of the peeling layer 12 as to obtain a high-quality image.

In the heating roller 2, the thickness of the second elastic layer 11 is set at 150 μm, and the thickness of the peeling layer 12 is set at 30 μm. Here, the tensile elasticity modulus of the peeling layer 12 is varied in three levels: $1.96\times10^8$ Pa ($0.2\times10^4$ kg/cm$^2$); $5.88\times10^8$ Pa ($0.6\times10^9$ kg/cm$^2$); and $9.8\times10^8$ Pa ($1.0\times10^4$ kg/cm$^2$). That is, three different heating rollers are prepared, and each of which is separately mounted in the fixing apparatus 1. Then, the fixability of the heating roller 2 and the effects thereof on a fixed image were examined. In Embodiment 2, the fixing temperature is set at 170° C. Formed on the recording sheet 5 is an unfixed color toner image composed of a single-layer color toner image. The adhesion mass per color toner image is set at 0.6 mg/cm$^2$. Other conditions are the same as those in Embodiment 1. In this embodiment, the fixing performance is evaluated based on a non-offset region and gloss property. The gloss property is examined by measuring a degree of gloss.

Listed in Table 2 are the evaluation results as to the fixing performance. In this table, symbol ○ represents that the gloss degree is greater than 15, and X represents that the gloss degree is less than 15. The results are evaluated basically in the same manner as in Embodiment 1.

TABLE 2

| Thickness of second elastic layer (μm) | Thickness of peeling layer (μm) | Tensile elasticity modulus (× $10^8$ Pa) | Non-offset region (° C.) | Gloss property | Evaluation result |
|---|---|---|---|---|---|
| 150 | 30 | 1.96 | 30 | X | Δ |
| 150 | 30 | 5.88 | 30 | ○ | ○ |
| 150 | 30 | 9.8 | 10 | X | X |

If the tensile elasticity modulus of the peeling layer 12 is unduly high, the surface of the heating roller 2 becomes so hard that the heating roller 2 fails to conform to concavities and convexities of the toner layer created on the recording sheet 5, resulting in occurrence of uneven heating and fixing failure. Consequently, neither a sufficient non-offset region nor excellent gloss property can be attained. When the tensile elasticity modulus of the peeling layer 12 is given as $9.8\times10^8$ Pa, the non-offset region is 10° C. This is considered impractical.

Figure 4:
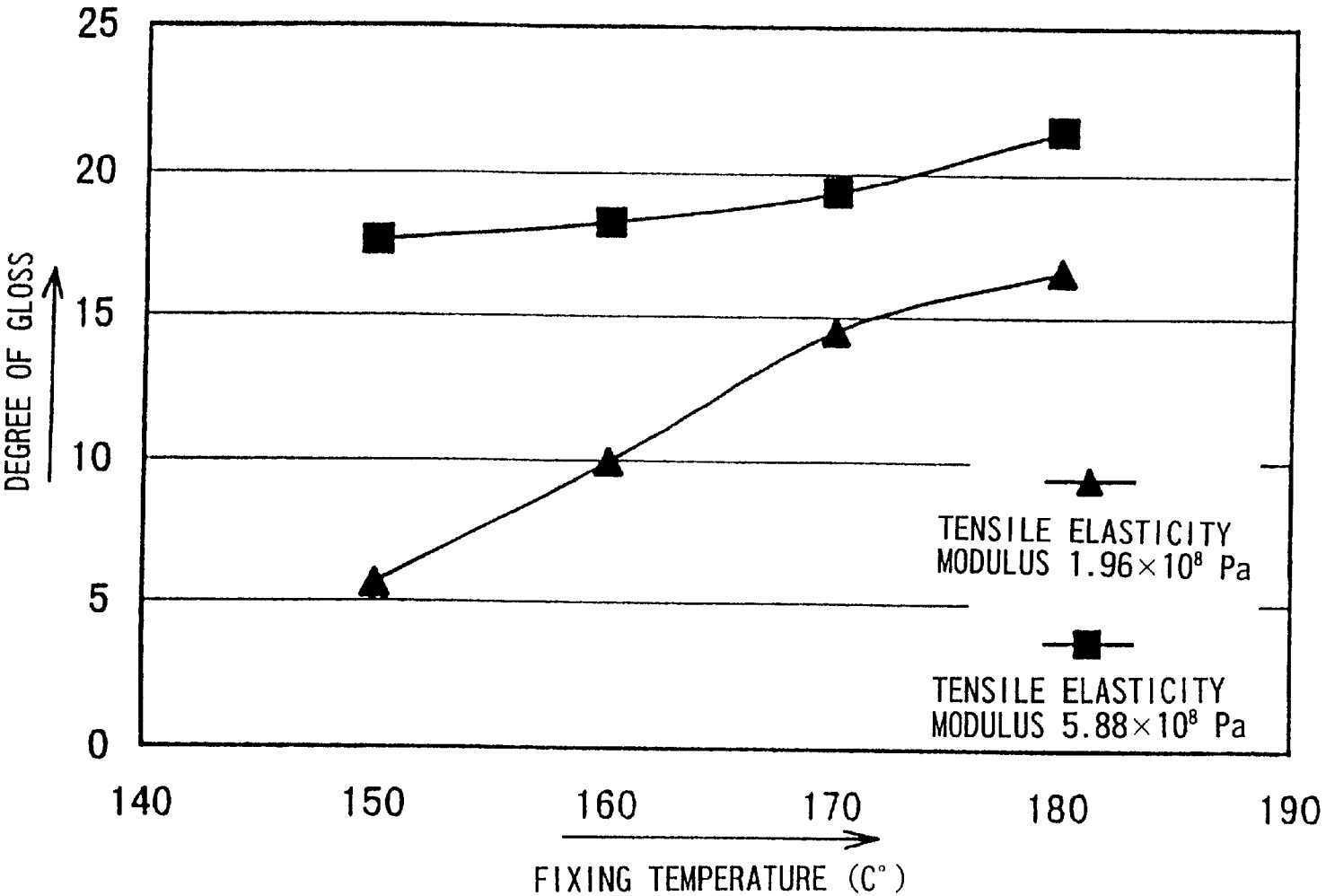
FIG. 4 is a graph showing gloss degree of toner that has been fixed by means of a heating roller 2 having a peeling layer 12 whose tensile elasticity modulus is set at $1.96\times10^8$ Pa or $5.88\times10^8$ Pa.

FIG. 4 is a graph showing the gloss degree observed when a single toner layer is formed with use of the heating roller 2 having the peeling layer 12 whose tensile elasticity modulus is set at $1.96\times10^8$ Pa or $5.88\times10^8$ Pa. More specifically, a graph showing the gloss degree of toner observed when a toner image is fixed onto the recording sheet 5, at varied fixing temperatures: 150° C.; 160° C.; 170° C.; and 180° C., in the fixing apparatus 1 incorporating two heating rollers 2 that differ from each other in the tensile elasticity modulus.

In outputting a color printed material, in particular a photo image, a certain level of gloss property is required. In a case where toner is single-layered, it is preferable that the gloss degree is kept at least at 15 or above. However, if the tensile elasticity modulus of the peeling layer 12 is low, the gloss degree is inevitably decreased. As shown in FIG. 4, the gloss degree of toner, when fixed by the heating roller 2 having the peeling layer 12 whose tensile elasticity modulus is set at $1.96\times10^8$ Pa, can be kept at 15 or above only when the fixing temperature is set at 180° C. At the other temperatures than 180° C., fixing is completed, but the gloss degree is insufficient. Thus, no practicality can be attained. In the end, if the peeling layer 12 has an unduly low tensile elasticity modulus, a high-quality image cannot be obtained. This is because, since the surface of the peeling layer 12 is made too soft, although the heating roller 2 conforms to the surface of the recording sheet 5 or concavities and convexities of the toner layer formed thereon, it is impossible to obtain a sufficient effect of crashing and smoothing toner to some extent. Therefore, the gloss property becomes insufficient.

On the other hand, with use of the heating roller 2 having the peeling layer 12 whose tensile elasticity modulus is set at $5.88\times10^8$ Pa, the gloss degree can be kept at 15 or above at any of the predetermined fixing temperatures. Eventually, a high-quality image can be obtained.

According to the foregoing results, it is preferable that the tensile elasticity modulus of the peeling layer 12 is kept in a range from $1.96\times10^8$ Pa to $9.8\times10^8$ Pa. By so doing, the heating roller 2 is allowed to adequately conform to concavities and convexities created on the surface of the recording sheet 5, and thus the non-offset region can be broadened. Consequently, the toner infiltrates into the recording sheet 5 properly so as to obtain a sufficient gloss degree.

Embodiment 3

Next, examination was made as to effects of a surface roughness of the peeling layer 12 on the fixing performance. In this embodiment, two different heating rollers 2 are prepared. In one of them, the surface roughness of the peeling layer 12 is set at 0.3 μm in terms of average surface roughness on the center line Ra, or set at 1.0 μm in terms of ten point average surface roughness Rz. In the other of them, the surface roughness of the peeling layer 12 is set at 0.4 μm in terms of Ra, or set at 2.0 μm in terms of Rz. In the fixing apparatus 1 incorporating each of the heating rollers 2, the fixing performance was evaluated based on the non-offset region. Moreover, in this embodiment, the thickness of the second elastic layer 11 of the heating roller 2 is set at 150 μm, and the thickness of the peeling layer 12 is set at 30 μm. Here, the peeling layer 12 has a tensile elasticity modulus of $5.88\times10^8$ Pa. The fixing temperature is set at 170° C. Other conditions are the same as those in Embodiment 1. Note that the surface roughness of the peeling layer 12 was measured in accordance with JIS B0601.

Here, the center-line average surface roughness Ra is defined by the following formula (1). That is, a part of measuring length l is extracted, in the direction of its center line, from a roughness curve. The center line of this extracted part is given as X-axis; the direction of vertical magnification is given as Y-axis; and the roughness curve is expressed by y=f(x). Then, the values given by the above formula (1) are expressed in micrometer (μm).

$$Ra = \frac{1}{l}\int_0^1 \left| f(x) \right| dx \tag{1}$$

The ten point average surface roughness Rz is defined as the difference, expressed in micrometer (μm), between the mean value of altitudes of peaks from the highest to the 5th, measured in the direction of vertical magnification from a straight line that is parallel to the mean line and that does not intersect the profile curve, and the mean value of altitudes of valleys from the deepest to the 5th, within a portion obtained by extracting only the reference length from the profile curve.

TABLE 3

| Ra (μm) | Rz (μm) | Non-offset region (° C.) | Evaluation result |
|---|---|---|---|
| 0.3 | 1.0 | 30 | ○ |
| 0.4 | 2.0 | 20 | X |

As seen from Table 3, the non-offset region varies according to the difference in surface roughness. If the surface roughness of the peeling layer 12 is increased, the surface of the heating roller 2 fails to conform to minute concavities and convexities of the toner layer created on the recording sheet 5, resulting in occurrence of uneven heating. Consequently, the non-offset region is decreased. Thus, in order for the heating roller 2 to conform to minute concavities and convexities of the toner layer created on the recording sheet 5, the surface roughness of the peeling layer 12 is set at 0.3 μm in terms of Ra, or set at 1.0 μm or below in terms of Rz. This makes it possible to broaden the non-offset region. Moreover, to decrease the surface roughness of the peeling layer 12, it is desirable to use a covered tubing material rather than a coating material.

As described heretofore, according to this embodiment, the conductive layer 10 of the heating roller 2 is heated by the external heating means 16. Alternatively, the conductive layer 10 of the heating roller 2 may be heated by internal heating means, or may be heated directly on the basis of a direct heating method.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a heating apparatus including:

a heating rotary member having a first elastic layer made of a material having elasticity, a conductive layer disposed in an outer periphery of the first elastic layer, a second elastic layer, made of a material having elasticity, disposed in an outer periphery of the conductive layer, and a peeling layer disposed in an outer periphery of the second elastic layer, wherein a tensile elasticity modulus of the peeling layer is kept in a range from $1.96\times10^8$ Pa to $9.8\times10^8$ Pa;

a pressure-applying member disposed in press-contact with the heating rotary member, for allowing a sheet-like to-be-heated material to be conveyed by the heating rotary member and the pressure-applying member as nipped therebetween; and heating means for applying heat to the conductive layer of the heating rotary member;

a visible image forming unit for forming a toner image on a to-be-heated material; and conveying means for conveying a to-be-heated material having a toner image formed thereon in a region between the heating rotary member and the pressure-applying member.

2. The image forming apparatus of claim 1, wherein the heating means is external to the heating rotary member.

3. A heating apparatus comprising:

a heating rotary member including: a first elastic layer made of a material having elasticity; a conductive layer disposed in an outer periphery of the first elastic layer; a second elastic layer made of a material having elasticity, which is disposed in an outer periphery of the conductive layer; and a peeling layer disposed in an outer periphery of the second elastic layer;

a pressure-applying member disposed in press-contact with the heating rotary member, for allowing a sheet-like to-be-heated material to be conveyed by the heating rotary member and the pressure-applying member as nipped therebetween; and heating means for applying heat to the conductive layer of the heating rotary member, wherein a tensile elasticity modulus of the peeling layer is kept in a range from $1.96\times10^8$ Pa to $9.8\times10^8$ Pa.

4. The heating apparatus of claim 3, wherein the second elastic layer has a thickness in a range from 50 $\mu$m to 300 $\mu$m.

5. The heating apparatus of claim 3, wherein the peeling layer has a thickness in a range from 5 $\mu$m to 50 $\mu$m.

6. The heating apparatus of claim 3, wherein the conductive layer has a thickness in a range from 10 $\mu$m to 100 $\mu$m.

7. The heating apparatus of claim 3, wherein the second elastic layer is made of silicone rubber.

8. The heating apparatus of claim 3, wherein the peeling layer is made of a fluorine material.

9. The heating apparatus of claim 3, wherein a surface roughness of the peeling layer is set at 0.3 $\mu$m or below in terms of average surface roughness on the center line Ra, or set at 1.0 $\mu$m or below in terms of ten point average surface roughness Rz.

10. The heating apparatus of claim 3, wherein the heating means is induction heating means for generating induced currents by applying an alternating magnetic field to the conductive layer, and wherein the conductive layer liberates heat in the alternating magnetic field.

* * * * *